United States Patent [19]

Kotsuzumi et al.

[11] Patent Number: 4,652,153

[45] Date of Patent: Mar. 24, 1987

[54] WIRE DOT-MATRIX PRINTER

[75] Inventors: Yuzo Kotsuzumi; Ryouhei Ohsaki, both of Tokyo, Japan

[73] Assignee: Oki Electric Industry Co., Ltd., Tokyo, Japan

[21] Appl. No.: 758,275

[22] Filed: Jul. 24, 1985

[30] Foreign Application Priority Data

Jul. 25, 1984 [JP] Japan ..... 59-153131
Oct. 2, 1984 [JP] Japan ..... 59-205560

[51] Int. Cl.[4] ..... B41J 25/28; B41J 11/20

[52] U.S. Cl. ..... 400/56; 400/57; 400/59

[58] Field of Search ..... 400/55, 56, 57, 59

[56] References Cited

FOREIGN PATENT DOCUMENTS 58130 5/1976 Japan ..... 400/59
64229 5/1977 Japan ..... 400/56
106918 9/1977 Japan ..... 400/59
87388 5/1982 Japan ..... 400/59
96868 6/1982 Japan ..... 400/59
150592 9/1982 Japan ..... 400/56
53465 3/1983 Japan ..... 400/59
59090 4/1983 Japan ..... 400/59

*Primary Examiner*—Paul T. Sewell
*Attorney, Agent, or Firm*—Wenderoth, Lind & Ponack

[57] ABSTRACT

A wire dot-matrix printer has a print head which can be moved toward and away from a sheet or sheets of print paper by means of a stepping motor, the print head being movable from an initial position. The wire dot-matrix printer also includes a detector for detecting the thickness of the sheet or sheets of print paper by bringing the print head from the initial position into abutment against the sheet or sheets and then moving the print head back to the initial position, and a controller for determining the speed of movement of the print head with respect to a platen in parallel relationship thereto, based on information from the detector.

5 Claims, 6 Drawing Figures

WIRE DOT-MATRIX PRINTER

BACKGROUND OF THE INVENTION

1. Field of the invention

The present invention relates to a wire dot-matrix printer employing a wire dot-matrix print head spaced from a platen by a gap selected to suit the thickness of a sheet or sheets of print paper used, and more particularly to a wire dot-matrix printer having a wire dot-matrix print head which can be moved at a speed appropriate for the thickness of a sheet or sheets of print paper used.

2. Description of the Related Art

Wire dot-matrix heads have a plurality of wires that can be driven to impinge upon sheet of print paper disposed around a platen through an inked ribbon.

In printers employing such wire dot-matrix heads, there is a prescribed gap between the tip end of the print head and the platen, the gap being hereinafter referred to as a "head-to-platen gap". If the head-to-platen gap were too small, the ink ribbon would rub against the sheet to smear the surface of the same. If the head-to-platen gap were too large, the wires would impinge upon the sheet under a reduced force, resulting in a lowered ink density of the sheet. To avoid these problems, the head-to-platen gap should appropriately be selected.

When a thicker sheet of print paper is wound around the platen, the surface of the sheet is positioned more closely to the ink ribbon, and the sheet tends to contact the ink ribbon or push the ink ribbon against the print head. With a thicker sheet employed, therefore, the head-to-platen gap is required to be increased.

Conventional arrangements for adjusting a head-to-platen gap dependent on different thicknesses of sheets of print paper are disclosed in Japanese Laid-Open Patent Publications Nos. 51-58130 and 52-106918, for example. The arrangement disclosed in the former publication achieves a desired head-to-platen gap by moving a print head into abutment against a sheet of print paper on a platen with a stepping motor, and then reversing the stepping motor for a prescribed angular interval to space the print head from the sheet of print paper. The structure shown in the latter publication includes a light-emitting element held in contact by a small force with a sheet of print paper at all times to follow the surface of the sheet, and a light-detector element disposed in a fixed position for detecting a positional variation of the light-emitting element. The print head is moved toward or away from the sheet based on a signal from the light-detector element for thereby maintaining a suitable head-to-platen gap.

Since higher-speed printing capabilities are desired nowadays, it is preferable that the tip ends of the wires be as close as possible to the sheet of print paper to reduce the interval which the wires are to traverse. In addition, the print head is required to be moved at a high speed parallel to the platen for a higher-speed printing operation.

It is customary to make adjustments for moving the print head at as high a speed as possible in the case where the thickness of a sheet or sheets on the platen is relatively small and the wires can quickly return away from the platen.

If an increased number of sheets are used for copying purposes, then the total thickness of the sheets is increased with air layers present between the sheets.

When the wires hit the platen through the sheets, therefore, the wires remain in contact with the sheets for an increased period of time, and it will take a longer period of time to move the wires back away from the sheets. If the print head were moved at a speed adjusted on the basis of a relatively small sheet thickness, then the wires of the print head would tend to be caught by the sheets and be bent or broken.

The head-to-platen gap should therefore be adjusted dependent on the thickness of a sheet or sheets of print paper such that when the sheet thickness is greater than a certain thickness, then adjustments will be made to lower the speed of travel of the print head. One conventional practice, as shown in Japanese Laid-Open Patent Application No. 57-87388, has been to provide a detector for detecting a sheet thickness in excess of a prescribed thickness, independently of the mechanisms for adjusting the head-to-platen gap and the speed of movement of the print head. The detector generates a signal indicative of a sheet thickness for controlling the speed of movement of the print head so as to be lower when the sheet thickness is larger.

For higher-speed printing operation, the speed of travel of the print head has to be adjusted as well as the head-to-platen gap, as mentioned above. Although the aforesaid prior-art arrangements disclosed in the two publications can keep a desired head-to-platen gap, they fail to adjust the speed of travel of the print head in response to detection of the thickness of a sheet or sheets of print paper used.

The use of the detector for detecting a sheet thickness larger than a given thickness to adjust the speed of movement of the print head, as described above, is disadvantageous in that since the detector is disposed independently of the other components, the overall mechanism is complex and large in size.

SUMMARY OF THE INVENTION

It is an object of the present invention to provide a wire dot-matrix printer having a means for automaticaly adjusting a print head to meet various sheet thicknesses for achieving the best printing quality at all times.

Another object of the present invention is to provide a wire dot-matrix printer having a means for protecting print head wires against damage through detection of the thickness of a sheet or sheets of print paper used.

Still another object of the present invention is to provide a wire dot-matrix printer which is simple in structure and small in size.

The above and other objects, features and advantages of the present invention will become more apparent from the following description when taken in conjunction with the accompanying drawings in which a preferred embodiment of the present invention is shown by way of illustrative example.

According to the present invention, a wire dot-matrix printer has a print head which can be moved toward and way from a sheet or sheets of print paper by means of a stepping motor, the print head being movable from an initial position. The wire dot-matrix printer also includes a detector means for detecting the thickness of the sheet or sheets of print paper by bringing the print head from the initial position into abutment against the sheet or sheets and then moving the print head back to the initial position, and a controller for determining the speed of movement of the head with respect to a platen in parallel relationship thereto, based on information from the detector means.

The detector means operates by applying a certain number of pulses to the stepping motor to move the print head from the initial position into abutment against the sheet or sheets on the platen, then applying pulses to the stepping motor to reverse the same for moving the print head away from the sheet or sheets back to the initial position, counting the pulses applied to the stepping motor to reverse the same, storing thickness-dependent information based on the counted pulses in a storage unit, and reading out the thickness-dependent information to detect the thickness of the sheet or sheets. Based on the information indicating the detected thickness, the cntroller maintains an appropritate gap between the sheet or sheets and the print head, and determines the speed of movement of the print head with respect to the platen in a parallel relationship thereto.

DESCRIPTION OF THE PREFERRED EMBODIMENT

Figure 1:
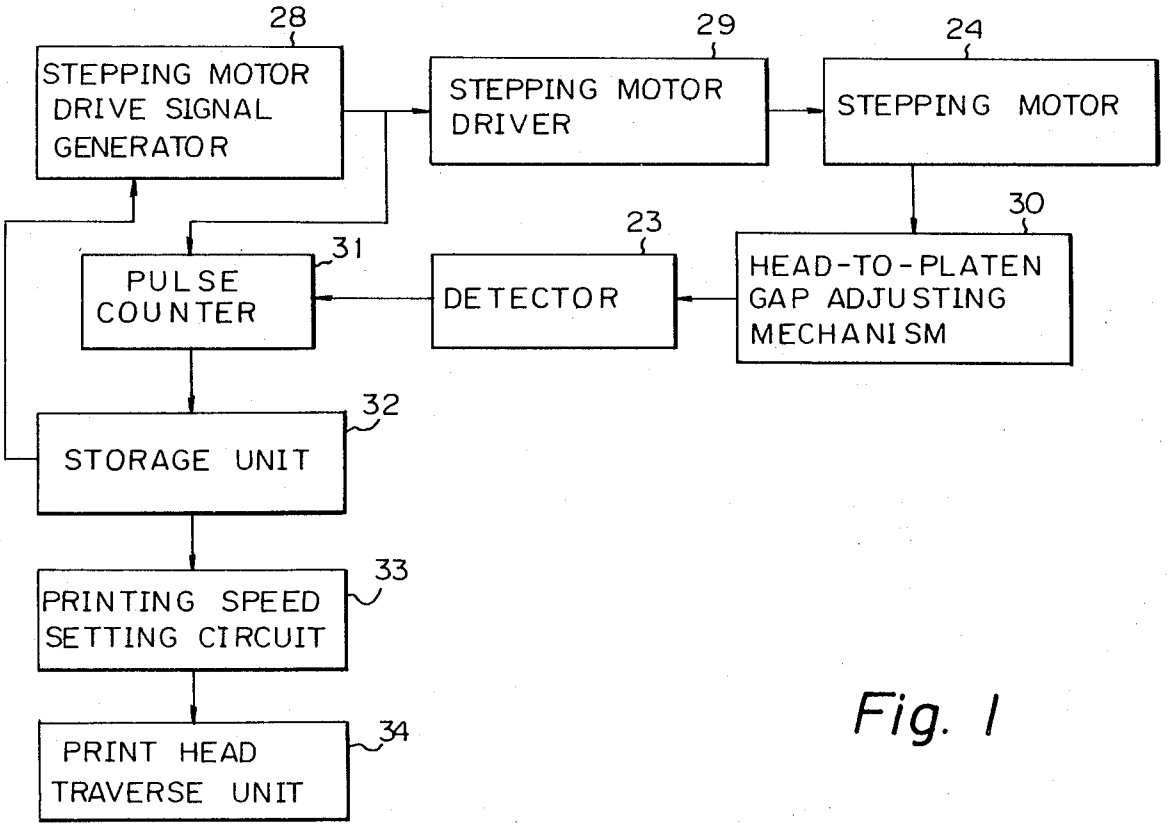
FIG. 1 is a block diagram of a controller of a wire dot-matrix printer according to the present invention.
Figure 2:
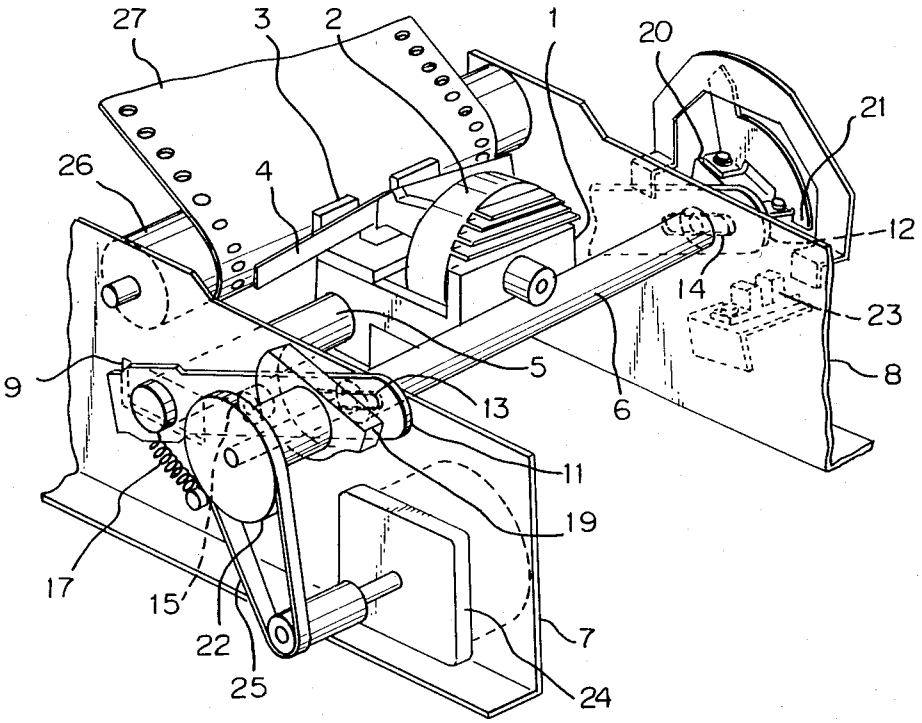
FIG. 2 is a fragmentary perspective view of the wire dot-matrix printer.

FIGS. 1 through 5 show a wire dot-matrix printer according to the present invention. The wire dot-matrix printer has a carriage 1, a wire dot-matrix print head 2 mounted on the carriage 1, a ribbon protector 3 fixed to the carriage 1 and positioned in front of the print head 2, an ink ribbon 4 supported for travel between the tip end of the print head 2 and the ribbon protector 3, a main shaft 5 extending parallel to a platen, described later, and supporting the carriage 1 for movement therealong, and a subshaft 6 extending parallel to the platen and supporting the carriage 1 for movement therealong. The main shaft 5 extends through a front portion of the carriage for allowing the carriage 1 to slide therealong. The subshaft 6 is held against a rotatable roller mounted on the rear end of the carriage 1.

The wire dot-matrix printer also has a pair of laterally spaced side frames 7, 8 having rectangular holes 9, 10 defined respectively therein. The main shaft 5 has opposite ends movably supported in the rectangular holes 9, 10, respectively. The subshaft 6 is rotatably supported on the side frames 7, 8. Links 11, 12 are supported on the opposite ends of the main shaft 5 and the subshaft 6. The links 11, 12 are swingably mounted on the main shaft 5, and movably mounted on the subshaft 6 through oblong holes 13, 14 defined in the links 11, 12, respectively. Cam follower rollers 15, 16 are rotatably mounted respectively on the links 11, 12. Springs 17, 18 are connected between the opposite ends of the main shaft 5 and the side frames 7, 8 for normally urging the main shaft 5 and hence the carriage 1 laterally in one direction. Cams 19, 20 are secured to the ends of the subshaft 6 and rotatable therewith to contact and push the cam follower rollers 15, 16 for moving the links 11, 12 against the forces of the springs 17, 18. A sensor lever 21 is fixed, together with the cam 20, to the end of the subshaft 6. A pulley 22 is fixed, together with the cam 19, to the opposite end of the subshaft 6. A detector 23 is mounted on the side frame 8 for detecting the position of the sensor lever 21 to detect an initial position of the print head 2. The pulley 22 is rotated by a stepping motor 24 mounted on the side frame 7 through an endless belt 25 trained around the pulley 22 and the pinion on the output shaft of the stepping motor 24.

The platen, denoted by 26, is rotatably supported by and between the side frames 7, 8 in a confronting relationship to the print head 2, the main shaft 5 and the subshaft 6 lying parallel to the platen 26. A sheet 27 of print paper is would around the platen 26.

Figure 3:
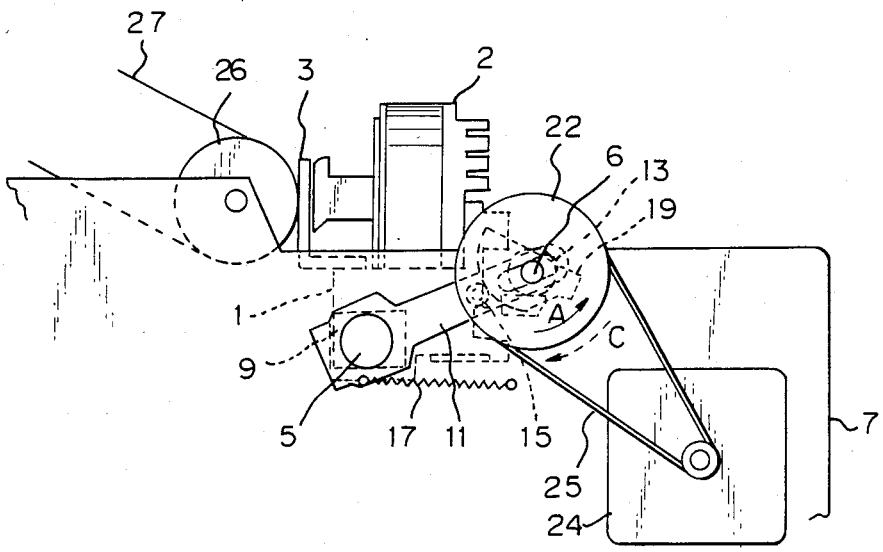
FIG. 3 is a lefthand side elevational view of the wire dot-matrix printer of FIG. 2.
Figure 4:
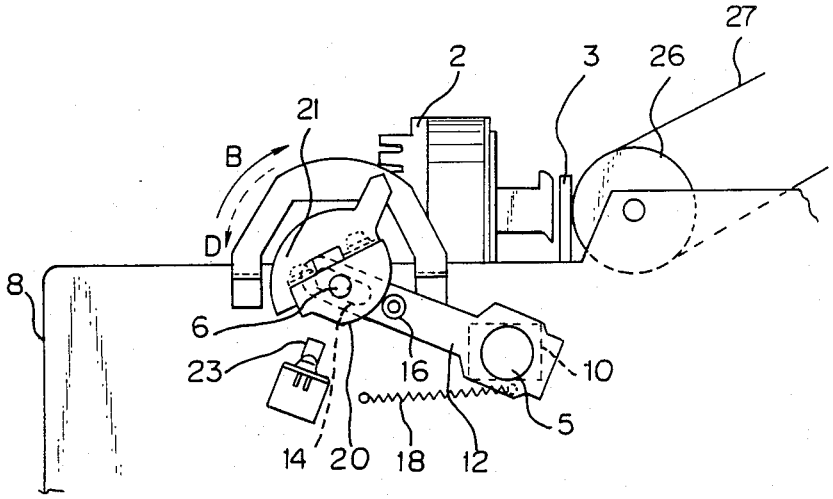
FIG. 4 is a righthand side elevational view of the wire dot-matrix printer of FIG. 2.

The operation of the wire dot-matrix printer thus constructed is as follows:

When the sheet 27 is disposed around the platen 26, a prescribed number of pulses are applied to the stepping motor 24 to start the stepping motor 24 to rotate. The rotation of the stepping motor 24 is transmitted by the belt 25 to the pulley 22 which rotates the subshaft 6 to rotate the cams 19, 20 in the directions of the arrows A, B (FIGS. 3 and 4), respectively. The cams 19, 20 push the cam follower rollers 15, 16 on the links 11, 12 which are moved toward the platen 26 against the bias of the springs 17, 18. The main shaft 5 is now moved by the links 11, 12 toward the platen 26 to move the carriage 1 and the print head 2 toward the sheet 27 until there is no gap between the ribbon protector 3 and the sheet 27, as illustrated in FIGS. 3 and 4.

The stepping motor 24 is now forcibly prevented from rotating, and is subjected to a step-out. However, the stepping motor 24 remains energized until the prescribed number of pulses are all supplied thereto. After the pulses have been supplied, other pulses are supplied to the stepping motor 24 to rotate it in an opposite direction.

The reverse rotation of the stepping motor 24 is transmitted through the belt 25 and the pulley 22 to the subshaft 6, which is then rotated in an opposite direction. The cams 19, 20 are now rotated with the subshaft 6 in the opposite direction to release the cam follower rollers 15, 16 progressively. The main shaft 5 is then moved with the links 11, 12 away from the platen 26 under the forces ofthe springs 17, 18.

Figure 5:
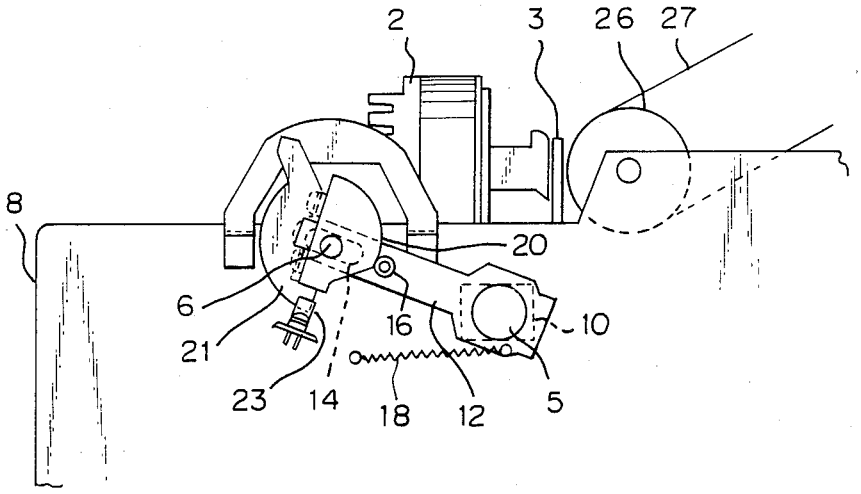
FIG. 5 is a view similar to FIG. 4, showing an initial position for a print head.
Figure 6:
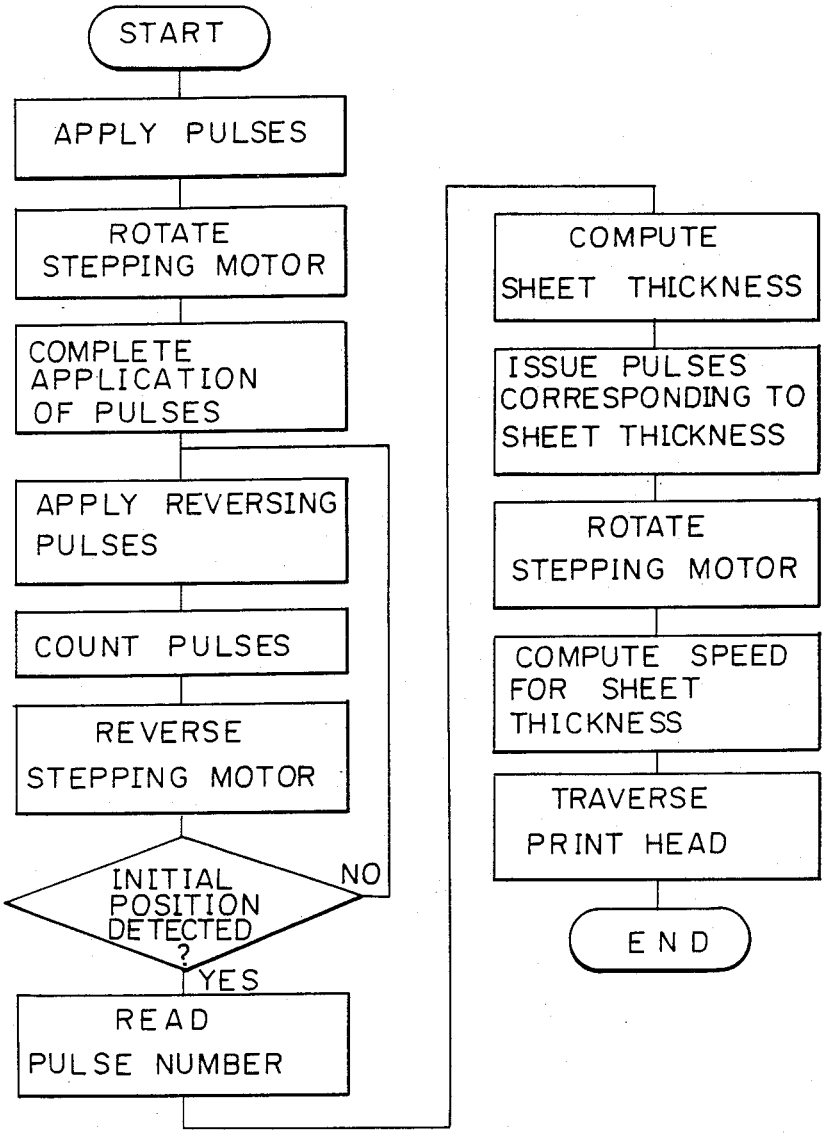
FIG. 6 is a flowchart of the operation for controlling the wire dot-matrix printer of the present invention.

The stepping motor 24 is continuously rotated in the reverse direction until the sensor lever 21 rotating with the subshaft 6 is moved toward and detected by the detector 23, as shown in FIG. 5. The position in which the carriage 1 is stopped after have been moved away from the platen 26 is the initial position of the print head 2.

The pulses applied to the stepping motor 24 upon its reverse rotation are counted by a controller, described later, which reads a sheet thickness corresponding to the pulse count out of a storage unit and determines the absolute thickness of the sheet 27.

Thereafter, a pulse nember corresponding to the detected sheet thickness is read out of the controller, and a corresponding number of pulses are applied to the stepping motor 24 to rotate the same stepwise for an angular interval proportional to the applied pulses for moving the carriage 1 and the print head 2 toward the platen 26 in the same manner as described above. The pulse number corresponding to the sheet thickness is selected to rotate the stepping motor 24 to provide a suitable gap between the sheet 27 and the ribbon protector 3 when the print head 2 is moved from the initial position toward the platen 26 and then stopped.

Now, a suitable head-to-platen gap is maintained between the print head 2 and the platen 26, and hence a suitable clearance suitable adjusted between the sheet 27 and the tip ends of the print head wires. The wires can then impinge upon the sheet 27 under an appropriate pressure for the best printing quality.

If the thickness of the sheet 27 is different from the thickness of a sheet which has previously been used on the platen 26, then the speed of movement of the carriage 1 and hence the print head 2 has to be adjusted to a suitable speed.

For such a speed adjustment, the controller detects the absolute thickness of the sheet 27 and at the same time reads a speed of movement of the carriage 1 with resepect to the platen 26, corresponding to the sheet thickness, out of a ROM or the like, and then controls a motor driver to move the carriage 1 at a speed suitable for the thickness of the sheet 27.

The speed of movement of the carriage 1 is generally selected to be as high as possible for a thin sheet of print paper. If the thickness of the sheet used were greater than such a given sheet thickness, then the print wires would remain in contact with the sheet for a longer period of time, and would tend to be damaged upon the movement of the carriage 1. Therefore, the speed of movement of the carriage 1 is required to be reduced for a thicker sheet of print paper, and conversely increased for a thinner sheet of print paper.

The controller for controlling the operation of the wire dot-matrix printer is illustrated in detail in FIG. 1.

The controller shown in block form in FIG. 1 operates as follows: A certain number of pulses are applied from a stepping motor drive signal generator 28 to a stepping motor driver 29 which rotates the stepping motor 24 in one direction. A head-to-platen gap adjusting mechanism 30 is driven by the stepping motor 24 to bring the ribbon protector 3 into contact with the sheet 27.

Then, pulses are applied from the stepping motor drive signal generator 28 to the stepping motor driver 29 to cause the stepping motor 24 to rotate in an opposite direction for thereby moving the carriage 1 and the print head 2 back to the initial position until the detector 23 for detecting the initial position is actuated.

The pulses generated by the stepping motor drive signal generator 28 to reverse the stepping motor 24 are counted by a pulse counter 31. In response to the pulse count from the pulse counter 31, items of information on a sheet thickness and a pulse number, corresponding to the pulse count, are read out of a storage unit 32 and applied to the stepping motor drive signal generator 28 and a printing speed setting circuit 33.

The stepping motor drive signal generator 28 computes the sheet thickness and issues a number of pulses corresponding to the sheet thickness to the stepping motor driver 29 for rotating the stepping motor 24 to actuate the head-to-platen gap adjusting mechanism 30. The carriage 1 and the print head 2 are moved again toward the platen 26 to maintain a suitable head-to-platen gap and an appropriate clearance between the sheet 27 and the wire tip ends.

The printing speed setting circuit 33 is responsive to the sheet thickness fed from the storage unit 32 for computing the sheet thickness and operating a print head traverse unit 34 for moving the carriage 1 and hence the print head at a speed corresponding to the sheet thickness parallel to the platen 26.

In the foregoing embodiment, the thickness of the sheet 27 is detected by detecting how many pulses are applied to the stepping motor 24 after the print head 2 has contacted the sheet 27 and before the print head 2 returns to the initial position. However, a contact member may be disposed for contacting the sheet 27, and the thickness of the sheet 27 may be detected by detecting a variation in the pressure at which the contact member is held against the sheet 27.

With the arrangement of the present invention, the print head is automatically, rather than manually, adjusted without error when a sheet of a different thickness is used, so that the best printing quality can be achieved at all times.

It is not necessary according to the present invention to detect a step-out condition of the stepping motor due to the contact of the carriage assembly with the sheet. The absolute thickness of the sheet can be detected without employing a special detecting element, so that the wires of the print head can be prevented from being damaged.

According to the present invention, the thickness of the sheet is detected by the movement of the print head to achieve a desired head-to-platen gap, and the speed of movement of the print head is adjusted on the basis of the detected thickness information. Therefore, no special means for detecting the sheet thickness is required, and the wire dot-matrix printer is simple in construction and small in size.

Although a certain preferred embodiment has been shown and described, it should be understood that many changes and modifications may be made therein without departing from the scope of the appended claims.

What is claimed is:

1. A wire dot-matrix printer comprising:

(a) a platen for winding a sheet of print paper thereon;

(b) a carriage supporting a print head and movable toward and away from said platen;

(c) a stepping motor operatively coupled to said carriage;

(d) first means for applying a number of first pulses to said stepping motor to rotate the same in one direction to move said print head toward the sheet on said platen;

(e) second means for applying a number of second pulses to said stepping motor to rotate the same in an opposite direction to move said print head away from the sheet on said platen toward a given position;

(f) third means for counting said second pulses required to move said print head back to said given position; and (g) fourth means for applying pulses to said stepping motor dependent on the thickness of said sheet based on a pulse count of said third means to rotate the steppping motor in said one direction to move said print head toward said sheet, for thereby automatically adjusting a gap between said print head and said sheet dependent on the thickness of the sheet.

2. A wire dot-matrix printer according to claim 1, wherein said second means is actuated to move said print head toward said given position after said stepping motor is subject to a step-out when said print head is moved by said first means toward said sheet.

3. A wire dot-matrix printer according to claim 1, including a storage unit for storing an appropriate pulse number dependent on the sheet thickness for rotating said stepping motor toward said sheet.

4. A wire dot-matrix printer comprising:

(a) a platen for winding a sheet of print paper thereon;

(b) a carriage supporting a print head and movable toward and away from said platen;

(c) a stepping motor operatively coupled to said carriage;

(d) first means for applying a number of first pulses to said stepping motor to rotate the same in one direction to move said print head toward the sheet on said platen;

(e) second means for applying a number of second pulses to said stepping motor to rotate the same in an opposite direction to move said print head away from the sheet on said platen toward a given position;

(f) third means for counting said second pulses required to move said print head back to said given position; and (g) fourth means for controlling the speed of movement of said print head along said platen dependent on the thickness of said sheet based on a pulse count of said third means, for thereby moving said print head along said platen at a speed dependent on the thickness of the sheet on said platen.

5. A wire dot-matrix printer according to claim 4, including a storage unit for storing an appropriate speed of movement of said print parallel to said platen which is dependent on the sheet thickness.

* * * * *